US005902015A

United States Patent [19]

Allcock

[11] Patent Number: 5,902,015

[45] Date of Patent: May 11, 1999

[54] SEAT BELT GRIPPING TOOL, AND METHOD OF USE

[76] Inventor: Shannon M. Allcock, 21304 Birdie La., Laytonsville, Md. 20882

[21] Appl. No.: 08/989,008

[22] Filed: Dec. 11, 1997

[51] Int. Cl.[6] ..... A47C 97/00

[52] U.S. Cl. ..... 297/463.1; 297/463.2; 297/250.1; 81/218; 81/420

[58] Field of Search ..... 297/463.1, 463.2, 297/250.1; 81/368, 318, 421, 420, 424.5, 488

[56] References Cited

U.S. PATENT DOCUMENTS

| | | | |
|---|---|---|---|
| 2,672,778 | 3/1954 | Jones | 817/368 |
| 3,842,696 | 10/1974 | Wayne | 81/420 |
| 4,386,542 | 6/1983 | Verna | 81/420 |
| 4,386,543 | 6/1983 | Walker, Jr. | 81/420 |
| 5,197,176 | 3/1993 | Reese | 297/250.1 |
| 5,255,579 | 10/1993 | Fortin | 81/421 |
| 5,496,083 | 3/1996 | Shouse, Jr. | 297/250.1 |
| 5,620,231 | 4/1997 | Marker | 297/250.1 |

*Primary Examiner*—Peter M. Cuomo
*Assistant Examiner*—Anthony D. Barfield
*Attorney, Agent, or Firm*—Shlesinger, Arkwright & Garvey LLP

[57] ABSTRACT

Gripping device includes a handle and an upper jaw disposed on the handle. A lower jaw is operatively associated with and moveable relative to the upper jaw. An upper plate is associated with the upper jaw and a lower plate is associated with the lower jaw. At least one of the upper and lower plates is offset relative to its associated upper/lower jaw. Preferably, at least one of the upper and lower plates are substantially flat. Preferably, both of the upper and lower plates are flat and an optional rubber pad may be placed thereon. Rubber teeth for gripping an object may be provided on the rubber pad. A safety latch may be provided for preventing inadvertent operation of the gripper. The gripping distance between the upper jaw and the lower jaw may be fixed so as to consistently and correctly grip an object, such as a vehicle seat belt, therebetween.

20 Claims, 4 Drawing Sheets

SEAT BELT GRIPPING TOOL, AND METHOD OF USE

FIELD OF THE INVENTION

This invention relates to a gripping tool. More particularly, this invention relates to a gripping tool suited for gripping belt-like material. Most particularly, this invention relates to a gripping tool particularly suited for gripping a vehicle seat belt, such as an automobile seat belt, and which may be used for securing the seat belt so as to maintain a child car seat in its proper position.

BACKGROUND OF THE INVENTION

Conventional vehicle/automobile seat belts often do not work well in securing child car seats in the seat of the automobile in which the child car seat is to be secured.

The problem of seat belts improperly securing child car seats is found when using "lap belt" type car seat belts, as well as "shoulder harness" type automobile seat belts.

The problem of improper securing of child car seats is especially prevalent when using shoulder harness type seat belts for securing the child car seat, especially as many users find it difficult to or do not understand how to properly secure child car seats in shoulder harness type seat belts.

FIGS. 1 and 2 illustrate a PRIOR ART clip 4 for restricting movement of a PRIOR ART child car seat 10 having arm rests 12 and a head rest 14.

Car seat 10 includes a rear 16 through which a left opening 18 and a right opening 22 pass.

A conventional shoulder harness type seat belt 24 is illustrated that is attached to the automobile at the factory. Shoulder harness belt 24 includes an upper piece 26 and a lower piece 28.

In order to secure car seat 10 to the unillustrated automobile, a portion of belt 24 is passed through openings 22 and 18.

PRIOR ART clip 4 includes an upper opening 42 and a lower opening 44. A connector 46 is disposed between upper and lower openings 42, 44, respectively.

Belt 24 is connected to conventional seat buckle 50 having a female portion 52 by use of the conventional male portion 54 which is typically slidably attached to belt 24.

For convenience, lower piece 28 of belt 24 is defined as the portion of belt 24 extending between male clip 54 and a lower fixed mount 60 secured to the automobile. Belt 24 is typically non-slidably secured to mount 60. Upper piece 26 of belt 24 is defined as the remaining portion of belt 24 extending between male clip 54 and an upper fixed mount 64 secured to the car and through which mount 64 belt 24 typically slidably extends for engagement with a conventional retractor mechanism 70.

In use, the PRIOR ART seat 10 is attached to the car by passing upper piece 26 and lower piece 28 of belt 24 through holes 18 and 22, and then clipping male clip 54 to female portion 52 of seat buckle 50. The user then is supposed to shorten the length of lower piece 28 of belt 24 for proper installation by pushing downwardly and rearwardly on seat 10 while pulling upper piece 26 of belt 24 upwardly and to the right, as viewed in FIG. 1, for shortening the effective length of lower piece 28 of belt 24.

PRIOR ART clip 4 is provided for maintaining the shortened length of lower belt piece 28 by preventing movement of upper piece 26 and lower piece 28 relative to each other; e.g., by preventing movement of belt 24 relative to male clip 54.

Clip 4 is attached by passing both upper and lower pieces 26 and 28 through upper opening 42, over connector 46, and down through lower opening 44.

Preferably, the user is supposed to place clip 4 as close as practical to male clip 54 so as to ensure that lower belt piece 28 is not lengthened, thereby leading to a loosening of car seat 10, which might lead to the undesirable movement of car seat 10 during use and/or in an accident, whereby a child secured therein is more likely to be injured.

In addition, clip 4 is intended to eliminate relative movement between upper belt piece 26 and lower belt piece 28 so that the forces exerted on car seat 10 during a automobile accident do not lead to relative movement between upper belt piece 26 and lower belt piece 28, thereby allowing the undesirable movement of car seat 10 described immediately above, the possibility of which might not have been readily apparent to a user prior to such a car accident.

Studies have shown, however, that users often do not appreciate the intended use of clip 4, nor the mechanical advantages realized by the proper use thereof, and fail to use the clip at all, or place the clip at a great distance from male clip 54, such as on the outside of right opening 22, for example.

Still further, under certain situations, such as when repeated application and withdrawal of forces on belt 24 is experienced, upper belt piece 26 may move relative to lower belt piece 28, thereby leading to the undesirable lengthening of lower belt piece 28 and, hence, loosening of car seat 10 relative to the automobile to which it is attached.

Additional examples of known child car seats include: U.S. Pat. No. 4,500,133 to Nakao et al.; U.S. Pat. No. 5,496,083 to Shouse, Jr.; and U.S. Pat. No. 5,527,094 to Hiramatsu et al.

Examples of known gripping devices include: U.S. Pat. No. 217,251 to Weaver and U.S. Pat. No. 4,386,542 to Verna.

Thus, it will be appreciated that there is a need for a gripping tool, a child car seat and tool combination, and a method of using a gripping tool for securing a car seat that is easier to use than prior art devices, and which overcomes the drawbacks of the PRIOR ART device.

The terms "left", "right", "upper", "lower", "child car seat" and "gripping tool", and the like are not intended to be limiting. In addition, the term "car seat", "infant seat", and "child carrier", for example, are intended to be synonymous terms, and are not intended to be limiting. "Vehicle", "car", and "automobile" are not intended to be limiting; such terms include airplanes, boats, buses, trains, amusement park rides, and all types of vehicles. Similarly, the terms "shoulder harness type seat belt" and "lap belt type seat belt" are not intended to be limiting.

OBJECTS OF THE INVENTION

Accordingly, it is an object of the invention to provide a gripping device which overcomes the drawbacks of prior art devices.

A further object of the invention is to provide a gripping device/car seat combination which overcomes the drawbacks of prior art devices.

Another object of the invention is to provide a gripping device engineered so that large static and dynamic loads exerted on a gripped object can be resisted.

Another object of the invention is to provide a gripping device which can be inexpensively manufactured.

A further object of the invention is to provide a gripping device which is suitable for retrofitting prior art car seats, as well as for use in new gripping device/car seat combinations.

Another object of the invention is to provide a gripping device which is easier and faster to install and use than conventional devices.

Yet a further object of the invention is to provide a gripping device which can be temporarily attached, as well as permanently attached, to a variety of objects.

Another object of the invention is to provide a gripping device which can be readily installed by one person.

A still further object of the invention is to provide a gripping device suited for "single-handed" installation.

It is a yet still further object of the invention to provide a junction box which is quicker to install than conventional devices.

A yet still further object of the invention is to provide a gripping device which is easier for professionals as well as for lay people to install.

A still further object of the invention is to provide a gripping device which is easier to precisely locate and install than conventional devices.

Another object of the invention is to provide a gripping device which can be readily installed by physically challenged people.

Another object of the invention is to provide a gripping device which is easier to correctly install, when used as a seat belt gripper, than known seat belt gripping devices.

A further object of the invention is to provide a gripping device which is easier to properly install than known devices.

It will be appreciated that each of the above objects of the invention applies to the inventive gripping device by itself, as well as to the inventive gripping device/car seat combination, and to the method of using such.

The invention will be further described with reference to the following drawings.

DETAILED DESCRIPTION OF THE INVENTION

Figure 1:
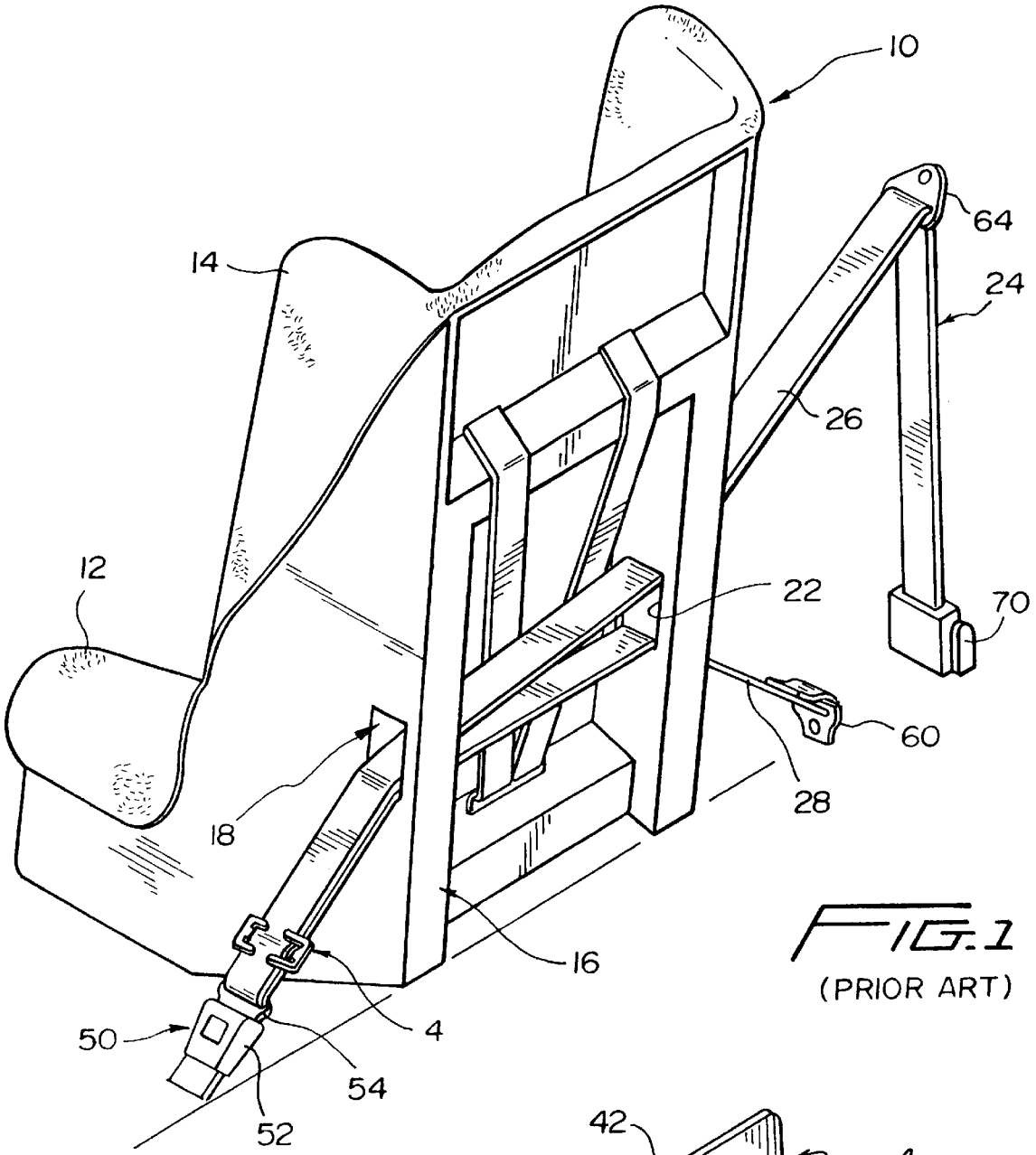
FIG. 1 (PRIOR ART)
FIG. 1 illustrates a PRIOR ART child car seat and belt clip combination, as described above.
Figure 2:
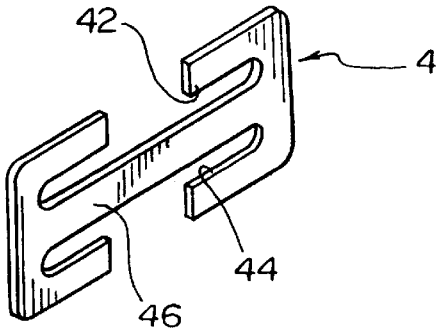
FIG. 2 (PRIOR ART)
FIG. 2 shows the PRIOR ART belt clip of FIG. 1.

Turning to FIGS. 3–10, a preferred embodiment of a gripping device or belt gripper 100 according to the invention will now be described.

Belt gripper 100 includes an upper handle 104 and, preferably, a lower handle 108. An upper or jaw pivot 110 may be provided on handle 104, while a lower or handle pivot 112 may be provided on lower handle 108.

An upper jaw 116 may be provided as an extension of upper handle 104.

A lower jaw 118 may be provided adjacent upper jaw 116. It is contemplated that lower jaw 118 be pivotably attached to upper handle 104 by means of jaw pivot 110. It is likewise contemplated that lower jaw 118 be pivotably attached to lower handle 108 by use of lower handle pivot 112.

A mouth 120 is preferably provided on gripper 100 for receiving objects to be gripped and/or handled.

Figure 3:
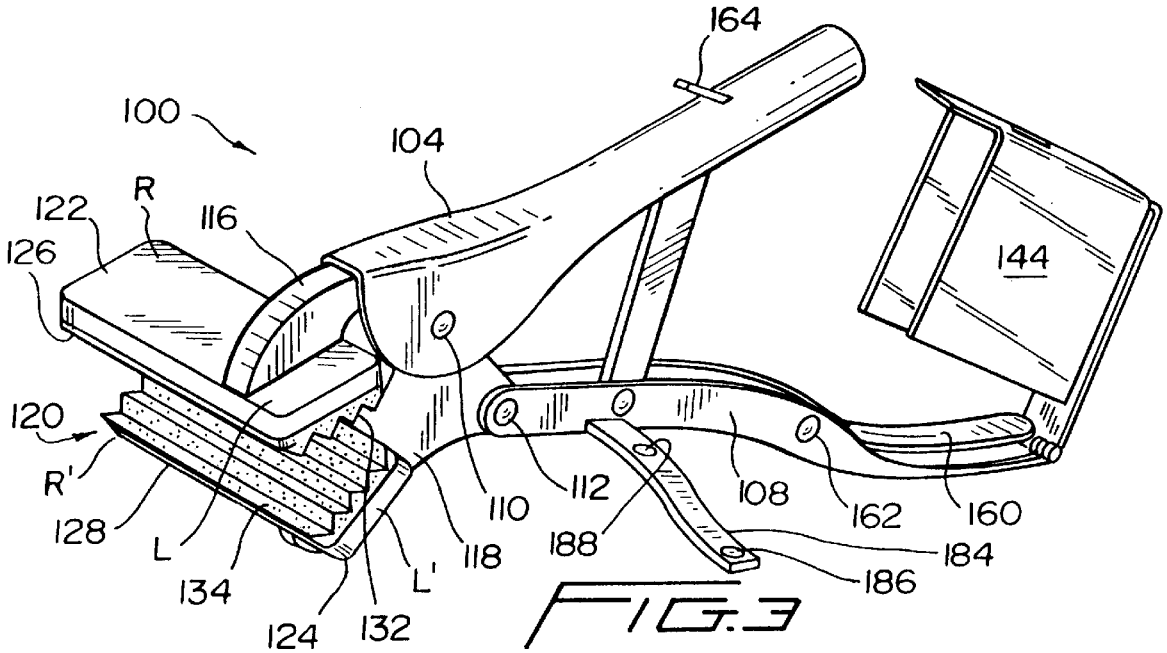
FIG. 3 is a perspective view of a preferred embodiment of a gripping device according to the invention.

Mouth 120 may be defined by the provision of an upper plate 122. A lower plate 124 may be provided offset from upper plate 122. Lower plate 124 may be sized so as to have substantially the same gripping area or "footprint" as upper plate 122. In that manner, an object gripped between and by upper plate 122 and lower plate 124 will be gripped substantially over the full extent thereof. As shown in FIG. 3, plates 122 and 124 are offset from their respective jaws 116 and 118. The right sides R and R' of plates 122 and 124 extends laterally a substantial distance from jaws 116 and 118 while the left sides L and L' of plates 122 and 124 extend a short distance laterally from their respective jaws 116 and 118.

It is further contemplated that a gripping pad, such as a rubber insert 126 be provided on upper plate 122, and that a rubber insert or gripping pad 128 be provided on lower plate 124. Preferably, upper pad 126 includes a plurality of teeth 132 which interlock with a plurality of mating teeth 134 provided on lower insert 128.

To resist inadvertent opening of mouth 120 when belt gripper 100 is in place and, hence, inadvertent releasing of gripped upper belt piece 26 and lower belt piece 28, it is contemplated that there be provided a safety latch 140 for preventing opening of mouth 120 when safety latch 140 is in its locked position.

Safety latch 140 includes a protective housing 144 and a downwardly extending extension 148 which may be fixedly attached thereto. A pivot 152 pivotably attaches extension 148 to an optional weld plate 156 which may be disposed on lower handle 108.

A release lever 160 pivotably attached to lower handle 108 by a pivot 162 is an example of a release mechanism which is protected from inadvertent release by protective housing 144. Release lever 160 and associated locking/release mechanism components may be constructed in a manner similar to those found on conventional so-called gripping or locking pliers, such as found on VISE-GRIP® brand locking pliers sold by Petersen Manufacturing Co., Inc.

A safety catch 164 may likewise be provided to ensure that safety latch 140 is not inadvertently opened and, thereby, provide access to release lever 160 for unintended opening of belt gripper 100 and mouth 120.

Safety catch 164 may include an extension 166 disposed on upper handle 104 and extendable through a mating hole 168. An elongated portion 172 may be provided on safety latch 140 that provides a mechanical advantage for a user to release safety catch 164 when belt gripper 100/mouth 120 is to be opened. As will be appreciated, safety catch 164, extension 166, hole 168 and elongated portion 172 may be configured and sized so that the strength of a typical adult is required in order to release safety catch 164 so as to restrict operation of safety catch 164 by a child.

An optional return spring 182 may be provided for assisting in the single-handed use of belt gripper 100 by being disposed and selected so that spring 182 tends to bring gripper to a position in which mouth 120 is closed.

An optional strap 184 may be attached to gripper 100 such as on lower handle 108, as illustrated. Preferably, a male connector 186 and a female connector 188 are provided for securing strap 184 and, hence, gripper 100 to an object such as a child seat 10. Male connector 186 and female connector 188 may be of the conventional "snap" type.

Figure 7:
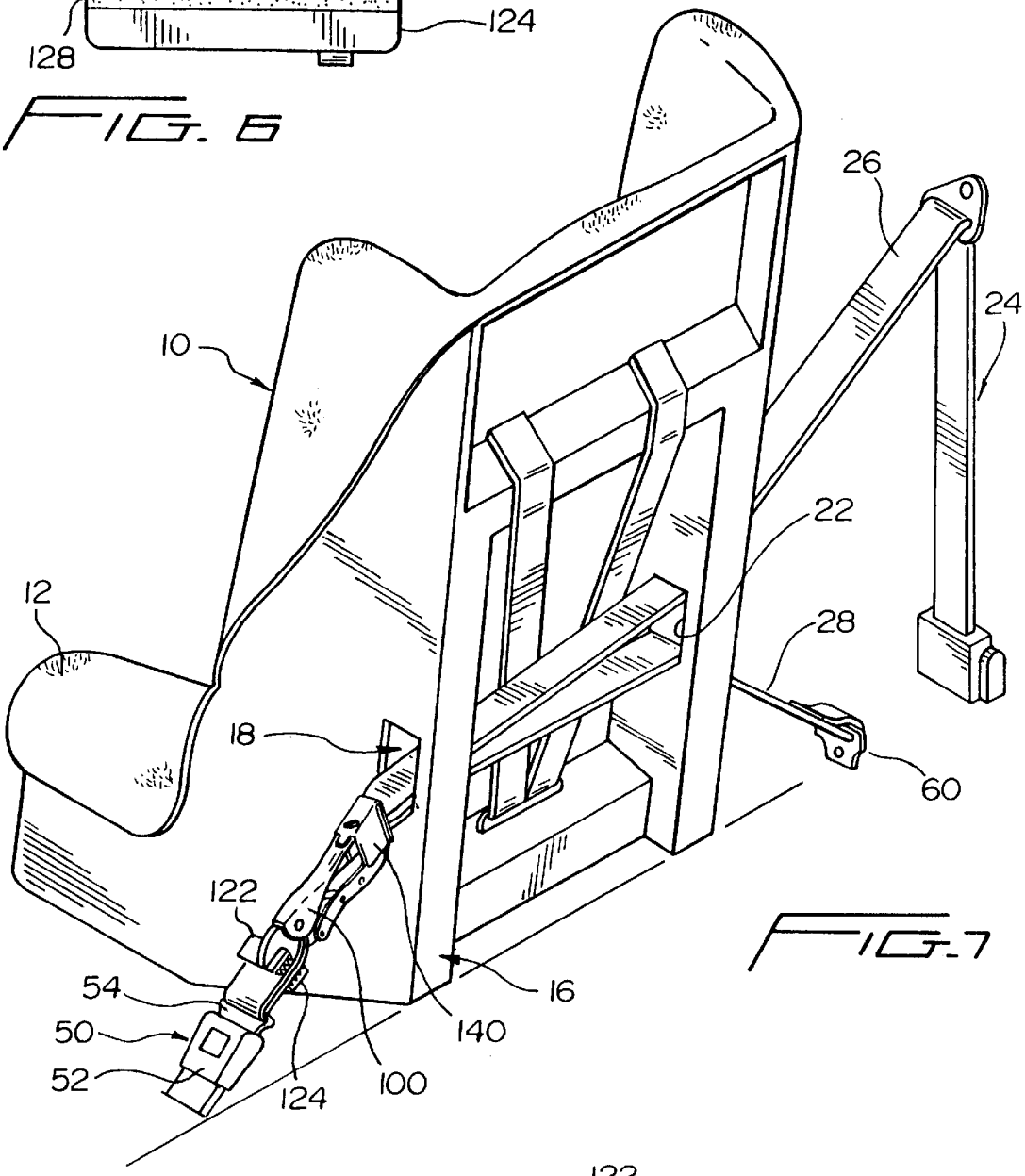
FIG. 7 is a perspective view showing the gripping device according to the preferred embodiment of FIG. 3 securing a conventional car seat to a shoulder harness type belt of an automobile.
Figure 9:
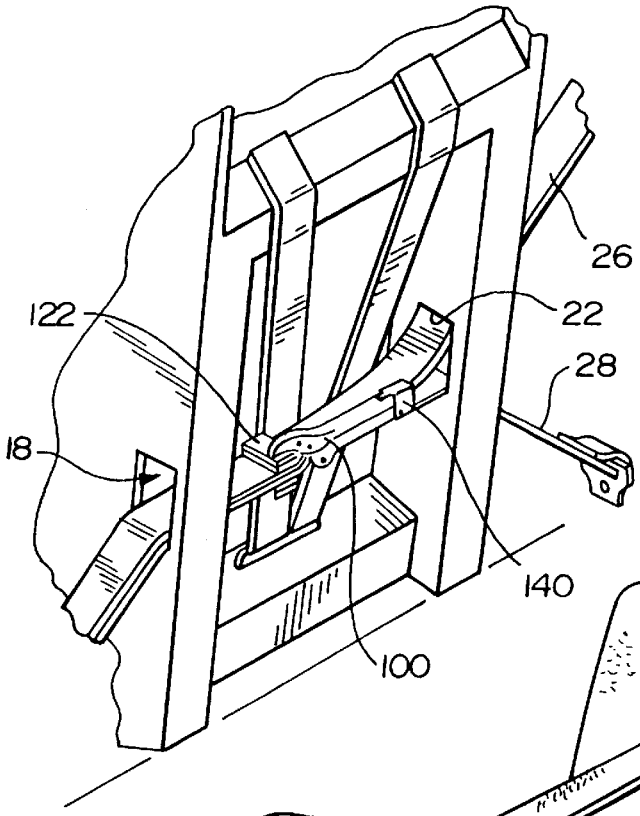
FIG. 9 is a perspective view similar to FIG. 7, showing the gripping device attached in a middle position.

FIG. 9 is a view similar to FIG. 7, showing gripper 100 in a middle position behind car seat 10.

Figure 10:
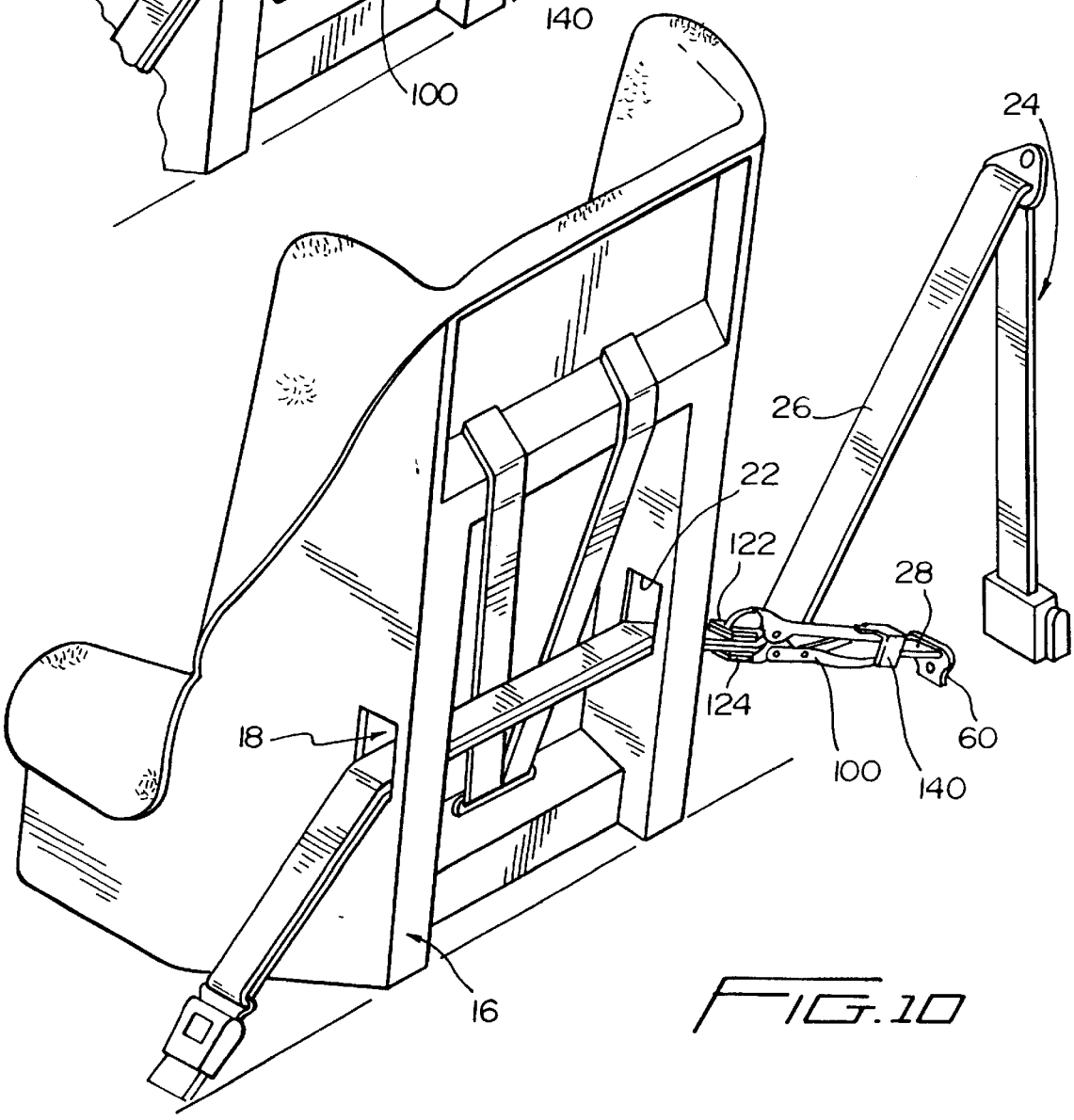
FIG. 10 is a perspective view similar to FIG. 9, showing the gripping device in a most preferred position on the right of the car seat.

FIG. 10 is a perspective view similar to FIG. 9, showing gripper 100 in a position on the right side of car seat 10. For many car seats 10 and vehicle installments, the right side location will be the "best mode" of carrying out the invention. It is also contemplated that gripper 100 face fixed mount 60; i.e., when gripper 100 clamps belts 26 and 28 its mouth 120 may be located adjacent fixed mount 60.

OPERATION

Figure 8:
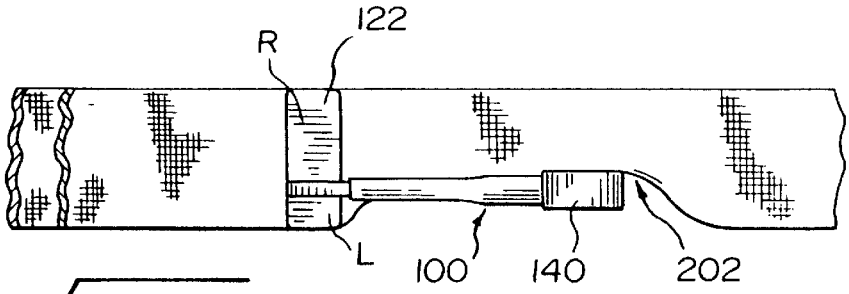
FIG. 8 is a plan view of the gripping device according to the preferred embodiment of FIG. 3, when gripping a seat belt, as in FIG. 7.

Turning to FIGS. 7 and 8, in particular, the operation of the preferred embodiment of belt gripper 100 may be appreciated.

In order to secure conventional car seat 10 having arm rest 12 to an unillustrated automobile, rear 16 of child seat 10 is oriented facing rearwardly in the unillustrated automobile, for example.

Male portion 54 of conventional seat buckle 50 is pulled leftwardly as seen in FIG. 7, and male portion 54 is threaded through right opening 22 and then through left opening 18 in rear 16 of conventional child seat 10.

Male portion 54 is inserted into female portion 52 of buckle 50.

The user then pulls upwardly and to the right, for example, on upper belt piece 26 so as to shorten the length of lower belt piece 28 a required amount (i.e., by moving belt piece 28 relative to male clip 54) in order to secure child seat 10 relative to the face of the automobile seat which engages rear 16 of child seat 10, as well as to secure the bottom of car seat 10 with the upper face of the seat portion of the automobile seat. Users may place one or both of their knees on the seat portion of child seat 10 so as to assist in the shortening of lower belt piece 28 by pressing downwardly and rearwardly on child seat 10 while concurrently pulling upwardly and rightwardly on upper belt piece 26, for example.

When the desired length of lower belt piece 28 and the consequent tightness/snugness of lower belt piece 28 pulling against the material of child seat holes 18 and 22 has been achieved, then the user places the open mouth 120 of gripper 100 over substantially parallel extending upper belt piece 26 and lower belt piece 28 in the region substantially adjacent to male portion 54 of buckle 50. Mouth 120 is closed by the user pressing downwardly on upper handle 104 while pulling upwardly on lower handle 108, for example, so as to close mouth 120, engage upper belt piece 26 and lower belt piece 28 with interlocking rubber teeth 132 and 134, and, hence, prevent relative movement of upper belt piece 26 relative to lower belt piece 28. The plates 122 and 124 when applied by gripper 100 to the belts 24 and 28, extend the full width of the belts 24 and 28 (FIGS. 7, 8), and when so applied, cause handle 140 to indent the belts 24 and 28 inwardly at 202 so that the handle 140 does not protrude beyond the outer edge of the belts 24 and 28 permitting maximum clearance and reducing interference of the gripper 100 when installed in a carseat 10 in a vehicle In that manner, the desired length and snugness of lower belt piece 28 is achieved.

After mouth 120 has been closed, it is preferable that protective housing 144 be rotated so as to cover a rear portion of upper handle 104 and bring extension 166 of safety catch 164 through hole 168 for locking protective housing 144 in position.

In order to release and remove car seat 10, the process is essentially reversed.

Figure 4:
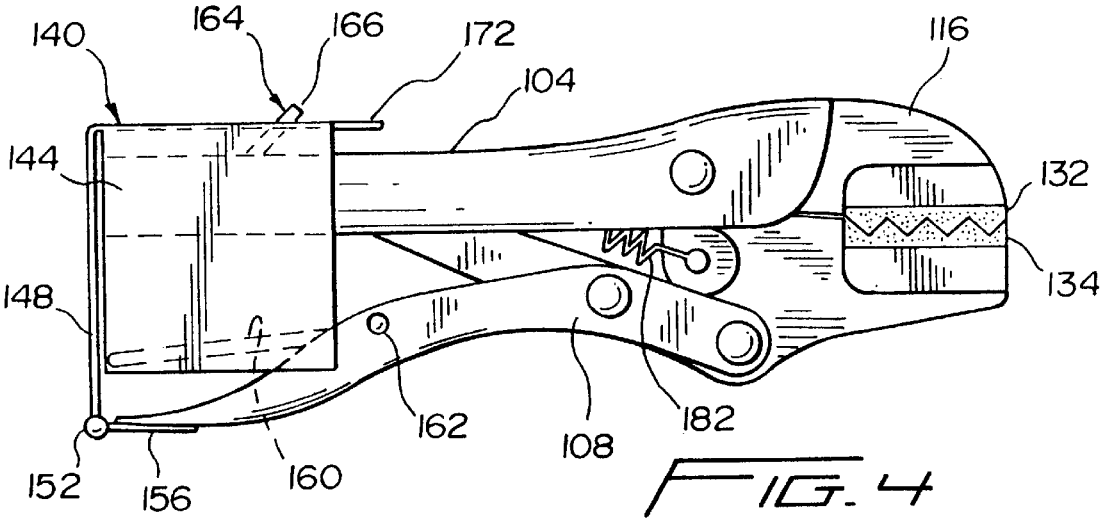
FIG. 4 is a side elevational view of the gripping device of FIG. 3.
Figure 5:
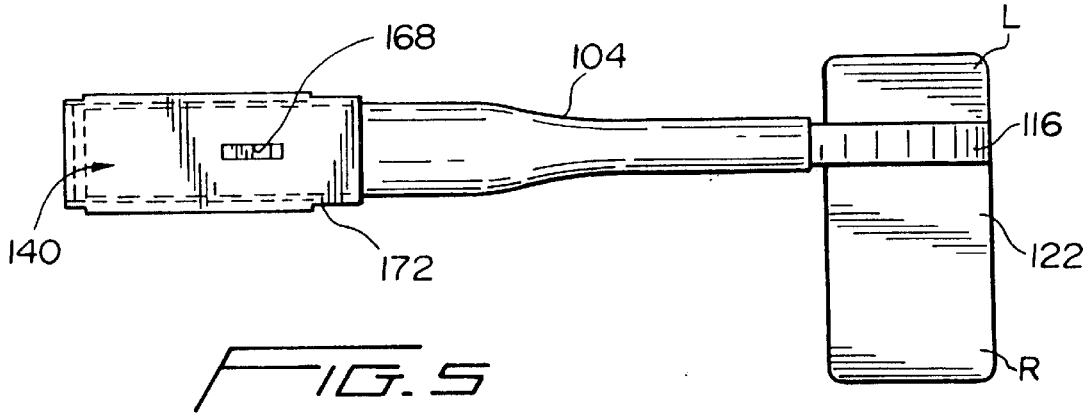
FIG. 5 is a top plan view of the gripping device of FIG. 3.
Figure 6:
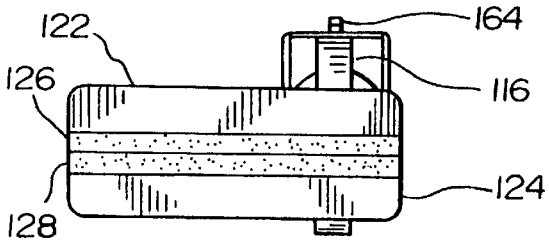
FIG. 6 is an end view of the gripping device of FIG. 3, such as when viewed from the right in FIG. 5.

Namely, the user pulls upwardly on elongated portion 172, such as viewed in FIGS. 4 and 7, disengages extension 166 from hole 168, and pivots protective housing 144 sufficiently away from upper handle 104 so as to allow upper handle 104 to be moved upwardly and released.

When optional release lever 160 is provided, release lever 160 is disengaged after movement of protective housing 144 out of the way of upward movement of upper handle 104, so that handle 104 may be readily moved.

When using optional strap 184, the free end thereof may be inserted through opening 22 of car seat 10, or around/through other portions of car seat 10. Strap 184 will typically be used to secure gripper 100 to car seat 10 when not in use.

It will be appreciated that all the objects of the invention have been achieved.

It is contemplated that various materials be used for constructing belt gripper 100, and that upper teeth 132 and lower teeth 134, for example, may be made of a variety of resilient materials, such as plastics and rubber, with such materials preferably being selected so as to do little, if any, damage to gripped seat belts.

It is further contemplated that the gripper 100 be provided with a ring (such as ring 14 of U.S. Pat. No. 4,386,542 to Verna) by which ring gripper 100 may be attached to car seat 10, for example, for storage. A strap, clip, snap, hook-and-loop fastener (e.g., VELCRO® brand) or other attachment device may be provided on one or both of gripper 100 or car seat 10 for securing gripper 100 thereto. Gripper 100 may be stored in the side, or on the upper middle rear portion of seat 10, for example.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. A gripping device, comprising:

a) a handle;

b) an upper jaw operatively associated with said handle;

c) a lower jaw which is substantially aligned with, operatively associated with and movable relative to said upper jaw;

d) an upper plate associated with said upper jaw, said upper plate having left and right sides;

e) a lower plate associated with said lower jaw, said upper plate having left and right sides; and f) at least one of said upper and lower plates being offset laterally relative to at least one of said upper and lower jaws, and having its right side extending laterally a substantial distance from said at least one of said upper and lower jaws, and its left side extending laterally a short distance from said at least one side of said upper and lower jaws, said short distance being shorter than said substantial distance.

2. A device as defined in claim 1, wherein:

a) both of said upper and lower plates are substantially flat.

3. A device as defined in claim 1, wherein:

a) both of said upper and lower plates are laterally offset substantially the same distance relative to said upper and lower jaws.

4. A device as defined in claim 1, wherein:

a) a pad is provided on at least one of said upper and lower plates.

5. A device as defined in claim 4, wherein:

a) at least one tooth configured for gripping an object is provided on said pad.

6. A device as defined in claim 4, wherein:

a) a pad is provided on both of said upper and lower plates.

7. A device as in claim 4, wherein:

a) a plurality of teeth configured for gripping an object is provided on said pad.

8. A device as defined in claim 1, wherein:

a) a locking mechanism is provided for preventing movement of said upper plate relative to said lower plate.

9. A device as defined in claim 8, wherein:

a) a release lever is provided for releasing said locking mechanism.

10. A device as defined in claim 9, wherein:

a) a safety latch is provided for preventing access to said release lever.

11. A device as defined in claim 1, wherein:

a) a safety latch is provided for preventing movement of said upper jaw relative to said lower jaw.

12. A device as defined in claim 1, wherein:

a) said upper plate and said lower plate define a gripping distance therebetween for gripping an object; and b) said gripping distance is fixed.

13. A method of installing a child car seat, comprising:

a) placing a child car seat in a vehicle of the type having a seat belt;

b) passing a portion of the vehicle seat belt through a portion of the child car seat for securing the car seat to the vehicle;

c) providing a gripper having a handle and a mouth defined by an upper plate and a lower plate movable relative to said upper plate;

d) placing the mouth of the gripper over a portion of the seat belt; and e) engaging the seat belt with the mouth to cause said handle to indent said belt inwardly so that said handle does not protrude beyond the outer edge of said belt permitting maximum clearance and reducing interference with said carseat for restricting movement of the seat belt for restricting movement of the car seat relative to the car.

14. A method as defined in claim 13, wherein:

a) said step of providing a gripper includes providing a gripper of the type having said upper and lower plates defining a gripping distance therebetween, and said gripping distance is fixed.

15. A method as defined in claim 13, wherein:

a) said step of providing a gripper includes providing a gripper of the type having a locking mechanism for preventing movement of the upper plate relative to the lower plate.

16. A method as defined in claim 13, wherein:

a) said step of passing the vehicle seat belt through a portion of the child car seat includes passing a shoulder harness type seat belt through the portion of the car seat.

17. A method as defined in claim 13, wherein:

a) said step of passing the vehicle seat belt through a portion of the child car seat includes passing a lap belt type seat belt through the portion of the car seat.

18. A method as defined in claim 13, wherein:

a) said step of providing a gripper includes providing an integrally attached handle.

19. A gripping device, comprising:

a) a handle;

b) an upper jaw operatively associated with said handle;

c) a lower jaw operatively associated with and movable relative to said upper jaw;

d) an upper plate associated with said upper jaw;

e) a lower plate associated with said lower jaw; and f) a center line of at least one of said upper and lower plates being laterally offset relative to a center line of at least one of said upper and lower jaws;

g) at least one of said upper and lower plates being substantially flat; and h) a pad having a plurality of teeth being provided on said at least one of said upper and lower plates.

20. A device as defined in claim 1, wherein:

a) at least one of said upper and lower plates is substantially flat.

* * * * *